US009551173B2

(12) United States Patent
Helisten

(10) Patent No.: US 9,551,173 B2
(45) Date of Patent: Jan. 24, 2017

(54) DOOR LOCK

(71) Applicant: ABLOY OY, Joensuu (FI)

(72) Inventor: Mika Helisten, Ylamylly (FI)

(73) Assignee: ABLOY OY, Joensuu (FI)

( * ) Notice: Subject to any disclaimer, the term of this patent is extended or adjusted under 35 U.S.C. 154(b) by 66 days.

(21) Appl. No.: 14/652,422

(22) PCT Filed: Nov. 5, 2013

(86) PCT No.: PCT/FI2013/051041

§ 371 (c)(1),
(2) Date: Jun. 15, 2015

(87) PCT Pub. No.: WO2014/096513

PCT Pub. Date: Jun. 26, 2014

(65) Prior Publication Data

US 2016/0186469 A1 Jun. 30, 2016

(30) Foreign Application Priority Data

Dec. 19, 2012 (FI) ..... 20126335

(51) Int. Cl.
*E05C 1/12* (2006.01)
*E05C 1/08* (2006.01)
(Continued)

(52) U.S. Cl.
CPC ..... *E05C 1/085* (2013.01); *E05B 15/102* (2013.01); *E05B 17/0058* (2013.01);
(Continued)

(58) Field of Classification Search
CPC ..... Y10T 292/08; Y10T 292/0982; Y10T 292/098; E05B 55/00; E05B 63/08; E05B 15/108
(Continued)

(56) References Cited

U.S. PATENT DOCUMENTS 2,097,232 A * 10/1937 Hartman ..... E05B 17/0025 292/192
2,807,488 A * 9/1957 Schlage ..... E05B 17/0025 292/163
(Continued)

FOREIGN PATENT DOCUMENTS

CN 2326700 6/1999
CN 2477769 2/2002
(Continued)

*Primary Examiner* — Mark Williams
(74) *Attorney, Agent, or Firm* — Muncy, Geissler, Olds & Lowe, P.C.

(57) ABSTRACT

The invention relates to a door lock provided with an oblique bolt. The objective is to decrease the external force directed into to deadlocking organs. The oblique bolt consists of slanted surfaces on both sides such that the tip part is narrower at its tip than in the back part of the tip part. The tip part has recesses in its lower part and upper part, which extend from the tip to the back part. Both recesses have a turning piece. Additionally, the oblique bolt has a support piece and flexing organs. The turning pieces guide external force up to a given turning angle via the support piece and flexing organs into the deadlocking organs.

13 Claims, 5 Drawing Sheets

Figure 1:
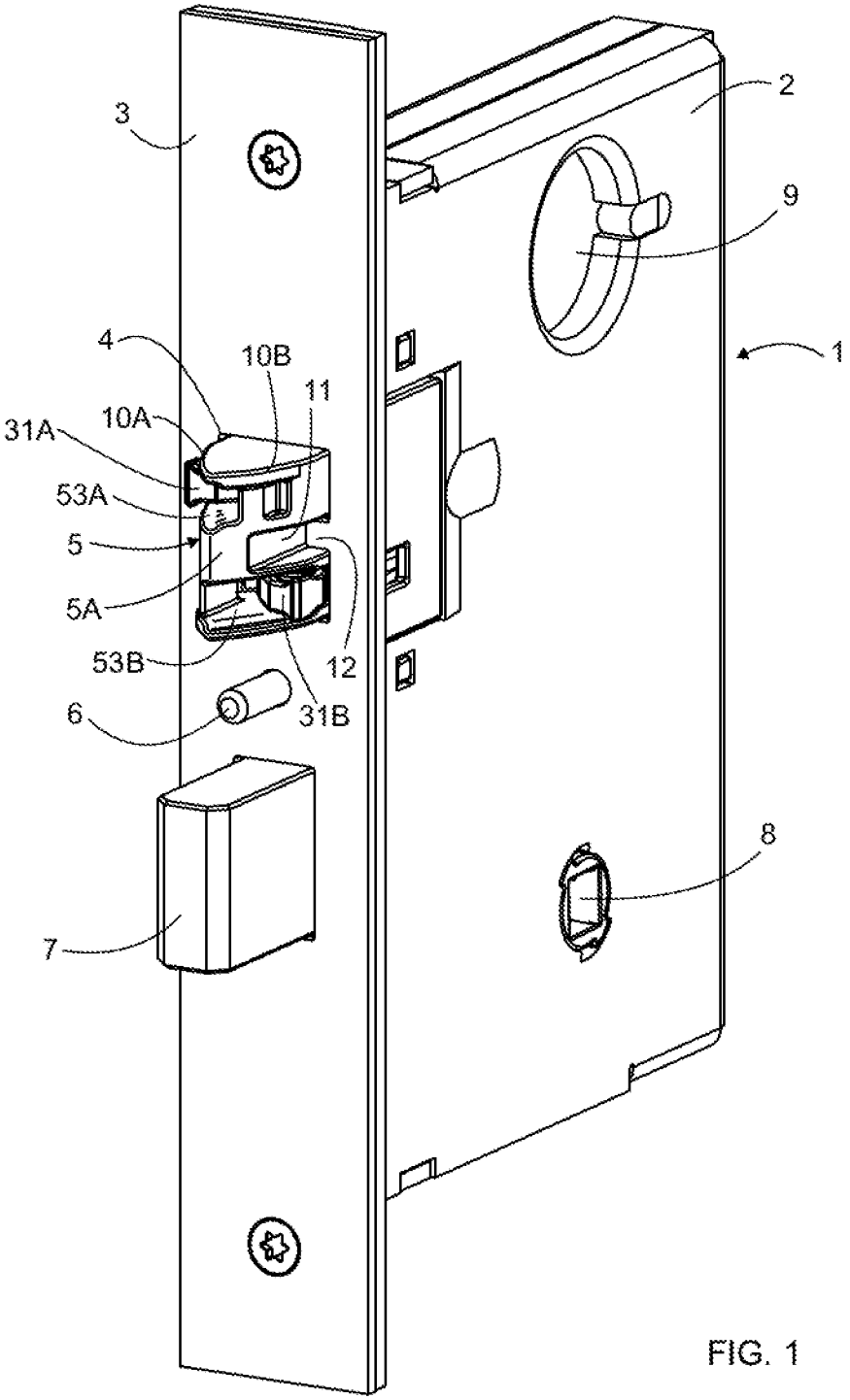

(51) Int. Cl.

| | |
|---|---|
| ***E05B 55/00*** | (2006.01) |
| ***E05B 65/06*** | (2006.01) |
| ***E05B 15/10*** | (2006.01) |
| ***E05B 17/00*** | (2006.01) |
| ***E05C 1/10*** | (2006.01) |
| *E05C 5/00* | (2006.01) |
| *E05B 15/04* | (2006.01) |

(52) U.S. Cl.
CPC ..... *E05B 55/00* (2013.01); *E05B 65/06* (2013.01); *E05C 1/10* (2013.01); *E05B 2015/0465* (2013.01); *E05C 5/00* (2013.01)

(58) Field of Classification Search
USPC ..... 292/167, 78, 163, 170, 169, 57, 58, 59,292/60, 61, 71
See application file for complete search history.

(56) References Cited

U.S. PATENT DOCUMENTS

| | | | | | |
|---|---|---|---|---|---|
| 2,917,336 | A * | 12/1959 | Schlage | E05B 17/0025 | 292/163 |
| 2,982,574 | A * | 5/1961 | Von Sternberg | E05B 65/06 | 292/159 |
| 3,492,038 | A * | 1/1970 | Fu | E05B 63/127 | 292/192 |
| 3,808,849 | A * | 5/1974 | Alexander | E05B 59/00 | 292/165 |
| 3,909,052 | A * | 9/1975 | James | E05C 1/163 | 292/169 |
| 4,902,053 | A | 2/1990 | Hakkarainen et al. | | |
| 5,113,676 | A * | 5/1992 | Panossian | E05B 55/12 | 292/18 |
| 5,794,991 | A * | 8/1998 | Smallegan | E05B 63/126 | 292/150 |
| 5,820,177 | A * | 10/1998 | Moon | E05B 17/007 | 292/335 |
| 7,603,880 | B2 * | 10/2009 | Chen | E05B 13/004 | 292/169 |
| 8,474,884 | B2 | 7/2013 | Helisten et al. | | |
| 2010/0262418 | A1 * | 10/2010 | Musa | G06F 17/2223 | 704/2 |

FOREIGN PATENT DOCUMENTS

| | | | |
|---|---|---|---|
| DE | 296 10 086 | U1 | 8/1996 |
| DE | 10 2010 028 651 | B3 | 7/2011 |
| EP | 0828047 | A2 | 3/1998 |
| EP | 0 940 532 | A3 | 9/1999 |
| EP | 1079054 | A1 | 2/2001 |
| FI | 82287 | | 10/1990 |
| FI | 120416 | B | 10/2009 |
| GB | 2 349 910 | A | 11/2000 |
| JP | 3-293491 | | 12/1991 |
| WO | WO 2009/014428 | A1 | 1/2009 |

* cited by examiner

DOOR LOCK

TECHNICAL FIELD

The invention relates to a door lock comprising an oblique bolt. In particular, the invention relates to door locks with oblique bolts, in which the oblique bolt contains moving bolt sections. Oblique bolts of this kind are often also called double action bolts.

PRIOR ART

Patent publications FI 82287 and FI 120416 present oblique bolt structures, which have an oblique bolt comprising bolt sections. These sections are arranged as moveable in relation to the other parts of the bolt. As was already stated, oblique bolts of this kind are also called double action bolts. In this text, both of these designations are used. As can be seen from the said patent publications, a double action bolt usually comprises a body part, which is provided with a longitudinal axis of the face plate of the door lock, and two bolt sections, which are pivotally supported into the body part around its axis.

Double action bolts of this kind are used in application sites, in which the door lock must be such that the door can be opened by pushing/pulling it in one direction or the other, when the deadlocking means of the door lock are in a passive state, i.e. the unlocked position. By deadlocking means is meant the means in the lock, with which the bolt of the lock can be locked into the deadlocking position. In the deadlocking position, the bolt is in the extracted position from the body of the lock, and the bolt is unable to move inside the lock body.

From said publications is seen that both bolt sections have an oblique surface, which, as the door is placed shut, strikes against the striker plate, wherein the bolt section presses inside the lock body. The bolt sections are attached pivotally into the body of the double action bolt, wherein the bolt sections always form an oblique surface, which strikes against the striker plate as the door is turned shut or open, regardless of the direction, in which the door is turned. The striker plate presses therefore the bolt section into the same position with the other bolt section as the door is being shut or opened. In this case, the side surfaces of the bolt sections form a converging oblique surface. When the bolt is against the striker plate and partially in the opening of the striker plate (or the door is open), the bolt sections are in the position, in which the oblique bolt forms surfaces similar to a deadbolt towards the edge of the counter plate. If the lock has deadlocking means and they are placed to lock the oblique bolt into the extracted position, the bolt sections are not able to turn. If deadlocking means do not lock the oblique bolt, the oblique bolt functions as an oblique bolt in relation to both turning directions of the door.

In these modern types of oblique bolts comparatively great force is directed into the deadlocking means of the lock body, as the bolt sections transmit the force of opening/closing the door to the deadlocking means. Great forces are present particularly when a locked door, in which a lock has been installed and deadlocked, is attempted to be forcibly opened, such as in a burglary situation.

BRIEF DESCRIPTION OF THE INVENTION

The objective of the invention is to decrease the external force directed onto the deadlocking means of a door lock provided with an oblique bolt. These kinds of forces are present especially in burglary situations, as was already said above, as well as in emergency exit situations. The objective is achieved in the manner presented in the independent claim The dependent claims describe different embodiments of the invention. The invention is based on the idea that a part of the external force can be guided onto the face plate, wherein onto the deadlocking means is not directed such great stress.

A door lock according to the invention comprises a lock body provided with a face plate, having deadlocking means and an oblique bolt, which is to be moved back and forth in a linear movement between the retracted position and the extracted locking position from the lock body through the bolt hole in the face plate. The oblique bolt is spring-loaded towards said extracted position, and it comprises a tip part and a body part. The tip part is in the extracted position partially outside from the lock body, and it comprises slanted surfaces on both sides such that the tip part is narrower at its tip than in the back part of the tip part. The tip part has recesses in its lower part and upper part, which extend from the tip to the back part. Both recesses are open at the end of the tip of the tip part and on the other slanted surface such that the recess of the upper part is open on the opposite slanted surface than the recess of the lower part.

Both recesses have a turning piece comprising a bolt projection, which has a counter surface on its first side, and a turning projection, which is arranged to turn the turning piece, when the oblique bolt moves from the retracted position into the extracted position. Turning occurs such that the turning projection is against the support surface on the inside of the face plate, and the counter surface moves away from the slanted surface of the tip part. The turning piece further comprises a push projection having a push surface and, additionally, a curved turning surface on the other surface of the push projection towards the side surface of the recess.

The back part of the tip part has flexing organs and a support piece, which has a counter push surface towards the push surface. The support piece is arranged as moveable in relation to the tip part and the body part of the bolt and is located between the flexing organs and the turning pieces. The flexing organs are supported into the body part of the oblique bolt and are against the support piece. The turning pieces are arranged to be with the bolt projection turned outwards from the slanted surfaces in the extracted position, and to turn from an external force directed onto the counter surface such that, as the deadlocking means lock the oblique bolt into the extracted position, the push projection pushes the counter push surface using the push surface, causing support piece to turn and move towards the flexing organs, until the counter surface of the bolt projection is in the plane of the slanted surface of the tip part, wherein the exterior force is directed onto the slanted surface.

LIST OF FIGURES

Figure 2:
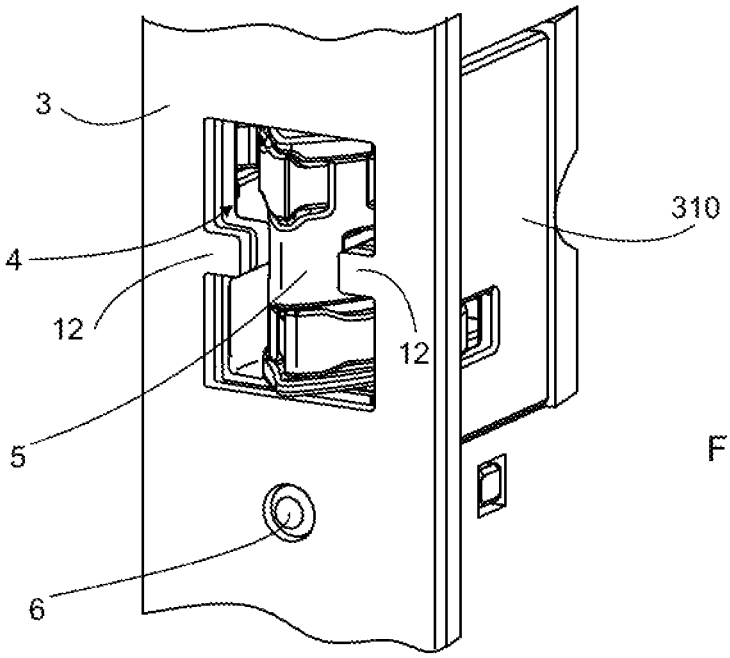
Figure 3:
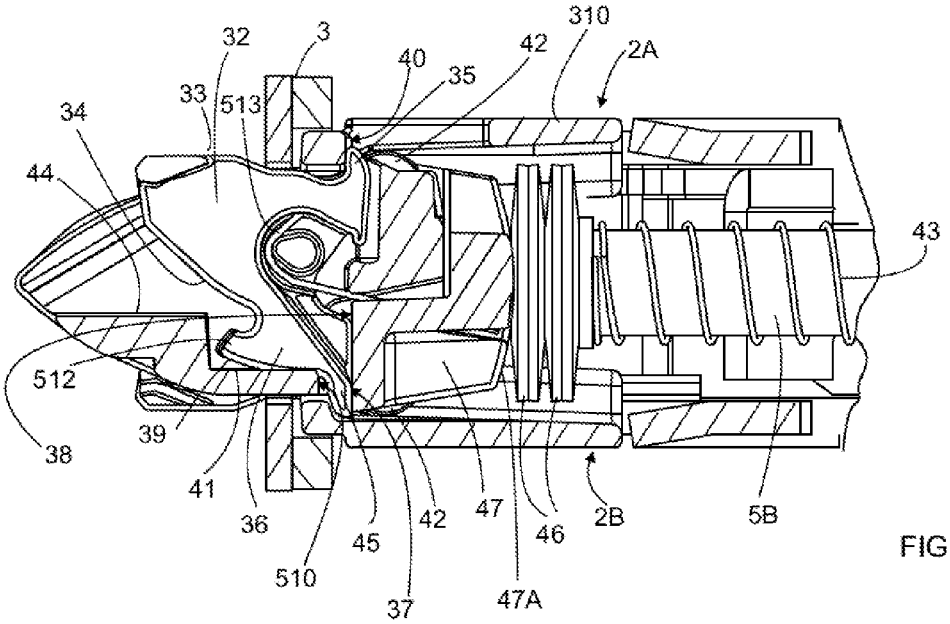
Figure 4:
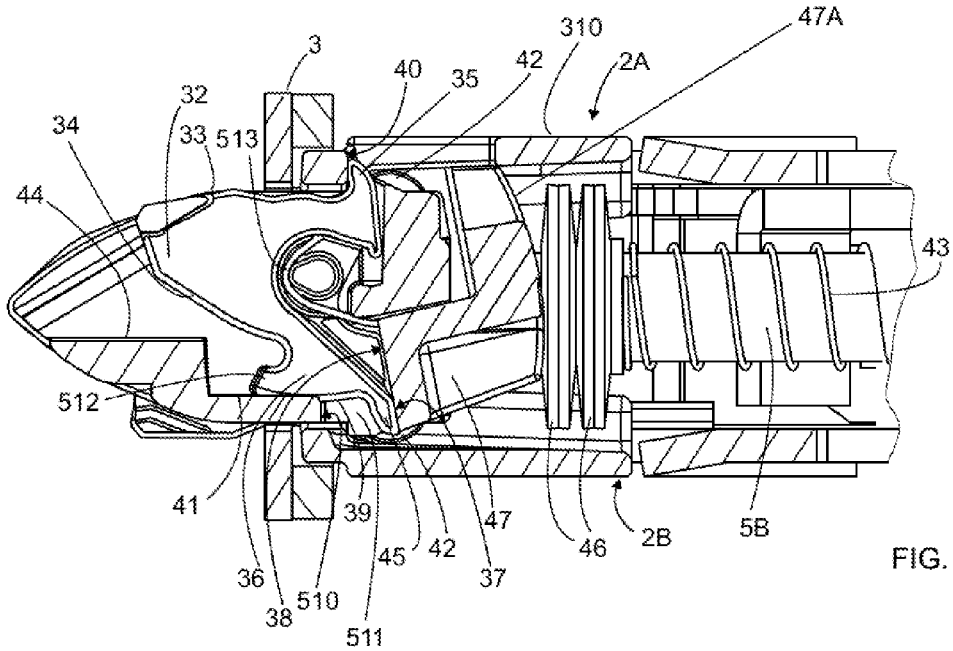
Figure 5:
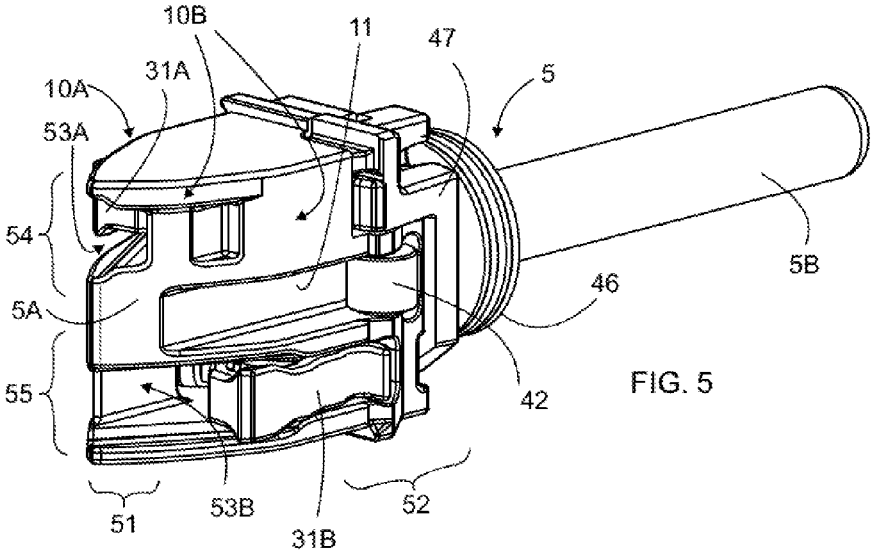
Figure 6:
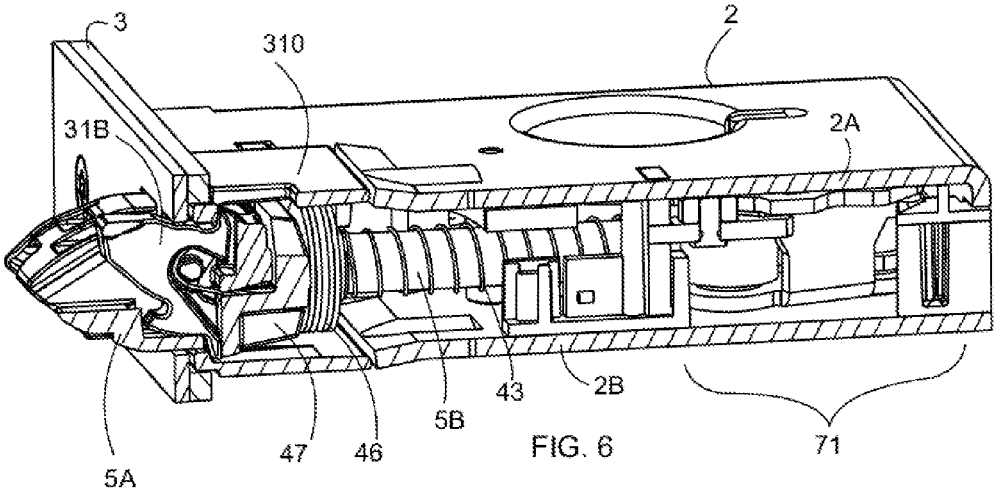
Figure 7:
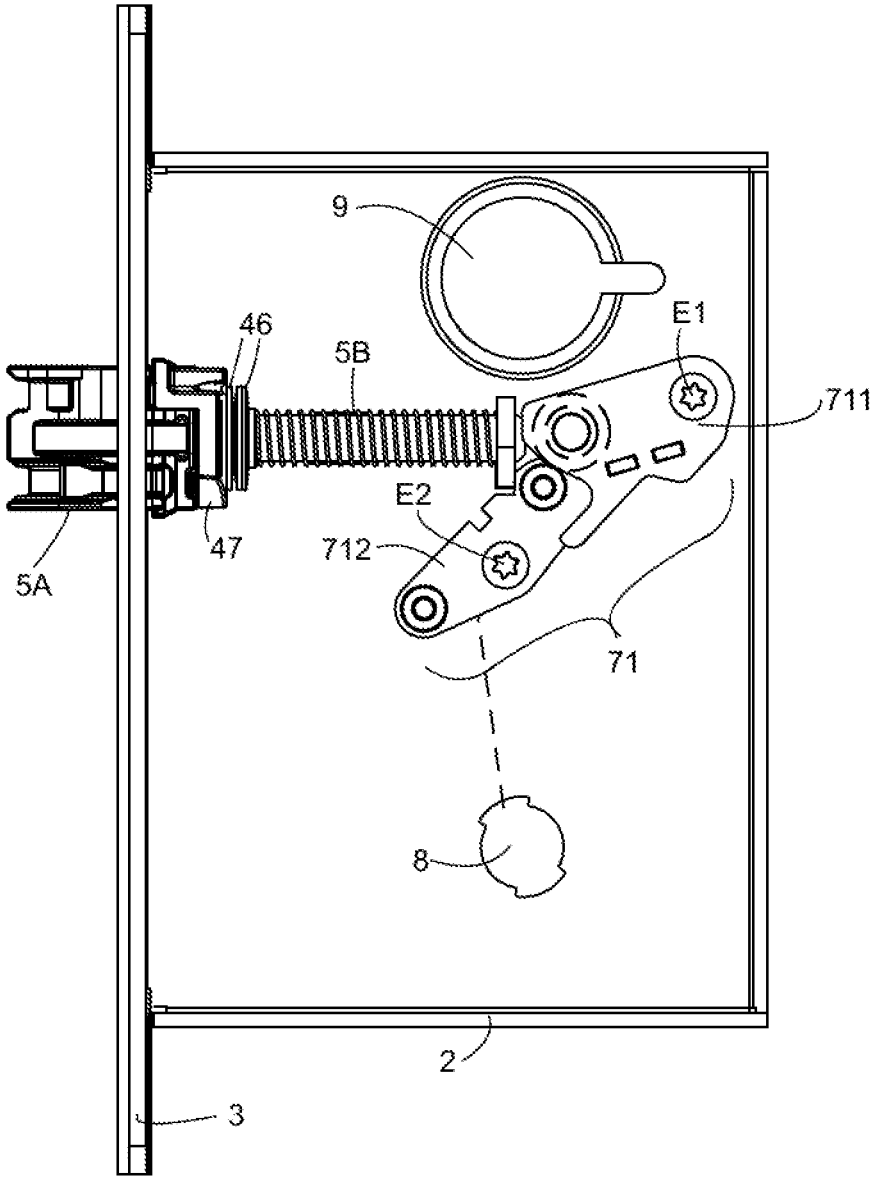

In the following, the invention is described in more detail by means of the figures of the accompanying drawings, in which FIG. 1 shows an example of a door lock according to the invention, FIG. 2 shows a part of the example of FIG. 1 with the oblique bolt inside the lock body, FIG. 3 shows a section of a lock according to the invention with the oblique bolt outside, FIG. 4 shows a section of a lock according to the invention with the oblique bolt outside, when an exterior force is directed onto the oblique bolt, FIG. 5 shows an example of an oblique bolt according to the invention, FIG. 6 shows another section of the lock with the oblique bolt outside, and FIG. 7 shows an example of a lock according to the invention and its deadlocking means.

DESCRIPTION OF THE INVENTION

FIG. 1 shows an example of a door lock 1 according to the invention. The door lock comprises a lock body 2 and a face plate 3. The face plate has an opening 4 for the oblique bolt 5. Additionally, in this example, the lock comprises an auxiliary wedge 6 to indicate the position of the door in relation to the frame of the door and a deadbolt 7 to strengthen the deadlocking of the door, wherein deadlocking can be implemented by the combined effect of two bolts, i.e. by the oblique bolt and the deadbolt. In the figure can also be seen the hole 8 of the axis of the pushbutton or twist knob as well as the place 9, for example, for the lock cylinder/lock cylinder organs used by a key.

In FIG. 1, the oblique bolt 5 is outside, or in the extracted position from the lock body. In FIG. 2, which shows a part of FIG. 1, the oblique bolt is inside, or in the retracted position. The lock body also has deadlocking means 71 (FIG. 7). When the deadlocking means are in the locking position, they lock the oblique bolt into the extracted position. When the deadlocking means are in the unlocked position, the oblique bolt can be pressed inside the lock body into the retracted position.

The oblique bolt is then to be moved back and forth in a linear movement between the retracted position and the extracted locking position from the lock body 2 through the bolt hole 4 in the face plate 3. The oblique bolt 5 is spring-loaded towards said extracted position, and it comprises a tip part 5A and a body part 5B (see FIG. 5.). The tip part is in the extracted position partially outside from the lock body.

The tip part 5A comprises slanted surfaces 10A, 10B on both sides such that the tip part is narrower at its tip 51 than in the back part 52 of the tip part. In the example of the figures, the slanted surfaces comprise slight curvature/portions at different angles. The slanted surfaces can also be formed as planar surfaces. The tip part has recesses 53A, 53B in its lower part 55 and upper part 54. The recesses extend from the tip 51 of the tip part to the back part 52 of the tip part. Both recesses are open at the end of the tip 51 of the tip part and on the other slanted surface 10A, 10B such that the recess of the upper part is open on the opposite slanted surface than the recess of the lower part. The figures clarify, how the recesses are open on opposite slanted surfaces.

Both recesses 53A, 53B have a turning piece 31A, 31B comprising a bolt projection 32, which has a counter surface 33 on its first side. FIGS. 3 and 4 show the turning pieces in more detail. The turning piece also comprises a turning projection 35, which is arranged to turn the turning piece, when the oblique bolt moves from the retracted position into the extracted position. This occurs as pushed by the spring 43 affecting the oblique bolt such that the turning projection is against the support surface 40 on the inside of the face plate 3, and the counter surface 33 of the bolt projection moves away from the slanted surface 10A, 10B of the tip part. The turning piece further comprises a push projection 36, which has a push surface 37 and a curved turning surface 39 on the other surface of the push projection 36 towards the side surface 41 of the recess. Additionally, the counter surface 33 of the bolt projection of the turning piece can comprise a portion wider than the remaining turning piece.

The back part 52 of the tip part has flexing organs 46 and a support piece 47, which has a counter push surface 38 towards the push surface 37. The support piece is arranged as moveable in relation to the tip part 5A and body part 5B of the bolt, and it is located between the flexing organs 46 and the turning pieces 31A, 31B. The flexing organs 46 are supported into the body part 5B of the oblique bolt, and they are against the support piece. Support of the flexing organs into the body part 5B can be implemented, for example, by a flange belonging to the body part or such that the diameter of the body part is greater in the back of the body part than at the site of the flexing organs. Thus, the body part has a threshold, against which the flexing organs rest. As is seen from the example of the figures, the flexing organs can be a disc spring assembly comprising one or more disc springs. Other suitable flexing organs can also be used. The spring means are preloaded.

The turning pieces 31A, 31B are arranged to be with the bolt projection 32 turned outwards from the slanted surfaces 10A, 10B in the extracted position of the oblique bolt, which is clearly seen in FIG. 3. Turning pieces are arranged to turn from an external force directed onto the counter surface 33 such that, as the deadlocking means 71 (FIGS. 6 and 7) lock the oblique bolt 5 into the extracted position, the push projection 36 pushes the counter push surface 38 using the push surface 37, causing the support piece 47 to turn and move towards the flexing organs 46, until the counter surface of the bolt projection is at least partially in the plane of the slanted surface 10A, 10B of the tip part. In this case, the external force is directed onto the slanted surface 10A, 10B.

FIG. 3 shows a situation, in which the oblique bolt is in the extracted position and the external force has not yet turned/moved the turning piece. FIG. 4 shows a situation, in which the external force has turned the turning piece to the plane of the slanted surface on that area, onto which the force is directed. The external force is directed onto that area, onto which the face plate installed into the frame of the door strikes as the door is opened. The distance between the counter plate and the face plate can vary slightly depending on the installation, but because this variation in distance is known in advance, then the shapes of the tip part 5A of the oblique bolt and the bolt projections 32 of the turning pieces according to the invention are implemented such that they take this variation into consideration. It is seen from the figures that the back surface 47A of the support piece 47, which is against the flexing organs 46, is rounded to ease turning/moving.

The slanted surface 10A, 10B is at a gently sloping or right angle in relation to the surface of the face plate 3 on that area, onto which the external force is directed, wherein the external force is directed onto the slanted surface at a right angle or at nearly a right angle. By gently sloping angle is meant an approximately 0-20 degree angle. In this case, the external force is directed onto the tip part of the oblique bolt at such an angle that the force is, in practice, crosswise in relation to the linear direction of movement of the oblique bolt, wherein the external force does not press the oblique bolt inside the lock body but instead towards the face plate. More specifically, the external force presses the oblique bolt against the edge of bolt hole 4 of the face plate.

Onto the deadlocking organs is directed then the external force in that stage, when it is directed onto the turning piece, wherein turning of the turning piece turns/moves the support piece, which, in turn, presses the flexing organs. The external force thus is transmitted via the flexing organs into the body part of the oblique bolt and from the body part onto the deadlocking means. When the function of the turning piece is examined more closely, it can be stated that the curved turning surface 39 of the push projection 36 of the turning piece slides on the side surface 41 of the recess. When the turning pieces are in the plane of the side of the oblique bolt, the tip part guides the external force onto the face plate. Hence, the deadlocking force does not increase to exceed that what the flexing organs transmit into the body part of the bolt. Thus, it is possible to use lighter and more sensitive deadlocking means.

In the normal state, when locked, the bolt touches the striker plate of the frame via the turning pieces. In a normal opening, a part of the external force is transmitted from the turning pieces via the support piece into the body of the bolt as a retracting force, when the deadlocking means are in the unlocked position. Whereas part of the force is transmitted along different routes (via different surfaces) onto the lock body. When the deadlocking is locked, i.e. in the locking position, and an attempt is made to forcibly open the door, the turning pieces push the flexing organs against the opposing support piece as long as the turning pieces are in the plane of the side surface, after which the oblique bolt receives the load (external force) in the manner of a deadbolt. When the load is removed, the flexing organs push the support piece into the original position (FIG. 3).

The push projection 36 of the turning piece 31A, 31B can comprise a nose 45, whose other side is included as a part of said push surface 37. In such an embodiment, the back part of the tip part has a rear surface 510 towards the counter push surface 38 such that there is a gap 511 between the rear surface and the counter push surface. The nose 45 is located in the gap, when the oblique bolt is in the extracted position. The push projection 36 of the turning piece can also comprise another nose 512 at the end of the curved turning surface 39. The other nose is towards the tip 51 of the tip part in the manner shown in the figures.

In the oblique bolt can be obtained additional functional reliability, when to it are added springs 513 for each of the turning pieces. The spring specific to a turning piece is arranged to turn the bolt projection 32 towards the other side surface 44 of the recess. With the aid of the springs, also the opposite turning piece turns in the direction of the recess, when the striker plate presses the turning piece of the other side, and the oblique bolt 5 tries to move inside the lock body, when the deadlocking means are in the unlocked position.

The lock body can have a roller 42 on both sides of the oblique bolt 5 between the side 2A, 2B of the lock body and the side of the oblique bolt. The rollers produce the easy movement of the oblique bolt between the extracted and retracted position. The rollers 42 can be placed, for example, in the grooves 11 formed on both sides of the oblique bolt, in which the rollers are located. In such an embodiment, the bolt hole 4 has projections 12, which extend into the grooves.

It is also possible to form an embodiment according to the example of the figures, in which the lock body 2 comprises at the site of the oblique bolt 5 a body piece 310, against which the rollers 42 are located. The body piece is shown, for example, in FIG. 6. Said support surface 40 on the inside of the face plate 3 for the turning projection 35 is also handy to arrange into the body piece. Use of the body piece can improve the assembly of the lock and facilitate production of the lock. Additionally, the roller characteristics of the rollers can better be controlled. If the invention is implemented without a body piece, the counter surface 40 is a part of the back surface (surface towards the lock body 2) of the face plate or possibly a part of the inner surface of the lock body for that part of the lock body 2, which is bent against the face plate 3. In the embodiment of the figures, the face plate is formed from two parts, but it can also be formed from one part.

In the examples presented above, the other side of the bolt projection 32 of the turning piece has a support surface 34, which is towards the other side surface 44 of the recess. When the deadlocking means 71 are not placed into the locking position, the oblique bolt is able to move inside lock body 2. As the door is opened, the striker plate in the frame of the door presses the counter surface 33 of the bolt projection. Due to this external force, the bolt projection 31 B turns in the recess 53B of the tip part such that the counter surface moves towards the slanted surface 10B, the curved surface 39 of the push projection turns on the side 41 of the recess, and the push surface 37 of the push projection pushes the oblique bolt 5 inside the lock body 2 against the force of the spring 43. In this case, the support piece 47 thus does not turn and move towards the flexing organs 46. The turning piece turns, until it has turned such that its support surface 34 is completely against the other side surface 44 of the recess. As can be observed, the turning piece pushes the oblique bolt inside the lock body at the same time as it turns in the recess. Only thereafter, when the support surface of the turning piece is completely against the other side surface of the recess, the striker plate of the frame presses in a direct manner the tip part of the oblique bolt, either in direct contact or via the turning piece, wherein the function corresponds to known oblique bolts, and the tip part moves deeper into the lock body into the retracted position. The turning piece therefore no longer turns in the final stage, when the oblique bolt moves inward in the lock body.

Because the oblique bolt is supported via rollers 42 into the lock body, and turning pieces 31A, 31B turn in the recess 53A, 53B, the wear to which the surfaces are subjected can be reduced and the movement of the oblique bolt is made easier than before. When the side surface of the recess is composed from two parts—from the side surface 41 and the other side surface 44—the rolling of the turning piece is also composed from two parts, wherein the rolling distance is made larger than with a uniform rolling portion. In the embodiment of the figures, the turning piece turns on the support surface of the bolt projection at its other end, which is the end on the side of the back part 52 of the tip part of the bolt. When the bolt piece is as turned against the other side surface 44 of the recess, the end of this support surface 34 is somewhat separate from the other side surface 44.

FIG. 7 shows an example of the deadlocking means 71 of the lock body. In the figure is, for purposes of clarity, not shown all the parts in the lock body. In this embodiment, the deadlocking means are implemented by two turnable plates 711, 712. One of the plates 711 turns in relation to the axis E1, whereas the other plate 712 turns in relation to the axis E2. In the figure, the deadlocking means are in the locked position. When the lower plate 712 turns clockwise, the other plate 711 turns counterclockwise, wherein the deadlocking means move into the unlocked position. In this example, the lower plate can be guided, for example, with a pushbutton, which is connected by a spindle into the hole 8. The dotted line shows this guiding. It is also possible to implement guidance of the deadlocking means, for example, by a lock cylinder, which is installed into a place 9 reserved for it, or by a solenoid. Different manners of guidance can thus be implemented in many manners known per se. Also the deadlocking means can be implemented in many different manners.

The structures of an oblique bolt according to the invention enable that onto the deadlocking means of the oblique bolt is directed a lesser force than in known oblique bolts, which comprise the bolt sections described in the introduction of this description. The force directed onto the deadlocking organs does not exceed that what the flexing means transmit into the body part. In earlier solutions, the bolt sections guide the external force via the body of the oblique bolt to the deadlocking means. The invention enables the lighter structure of the deadlocking means. The deadlocking means can also be implemented such that they function more easily. For example, an emergency exit door should open easily, despite that there might be horizontal force directed onto it. Additionally, maintenance intervals of the lock can even be increased. Due to the structures, the function is more reliable than in known solutions, and the lock has a longer service life. In burglary situations, a structure according to the invention withstands a greater lateral load.

In the light of the examples presented above, it is obvious that an embodiment according to the invention can be achieved by many various solutions. The shape of the tip part of the oblique bolt and the shape of the bolt pieces can vary. It is obvious that the invention is not limited only to examples mentioned in this text, rather it can be implemented by many various embodiments within the scope of the independent claim.

The invention claimed is:

1. A door lock comprising a lock body provided with a face plate, having deadlocking means and an oblique bolt, which is to be moved back and forth in a linear movement between a retracted position and an extracted locking position from the lock body through a bolt hole in the face plate and which oblique bolt is spring-loaded towards said extracted position, which oblique bolt comprises a tip part and a body part, which tip part is in the extracted position partially outside from the lock body, which deadlocking means lock in a locking position the oblique bolt into the extracted position and allow in an unlocked position the oblique bolt to move into the retracted position, wherein the tip part comprises slanted surfaces on both sides such that the tip part is narrower at its tip than in a back part of the tip part, and the tip part has recesses in its lower part and upper part, which recesses extend from the tip to the back part, both recesses being open at the end of the tip of the tip part and on the other slanted surface such that the recess of the upper part is open on the opposite slanted surface than the recess of the lower part, both of which recesses have a turning piece comprising a bolt projection, which has a counter surface on its first side, and a turning projection, which is arranged to turn the turning piece, when the oblique bolt moves from the retracted position into the extracted position such that the turning projection is against a support surface on the inside of the face plate, and such that the counter surface moves away from the slanted surface of the tip part, the turning piece further comprising a push projection having a push surface and a curved turning surface on another surface of the push projection towards a side surface of the recess, the back part of which tip part has flexing organs and a support piece, which has a counter push surface towards the push surface, and which support piece on is arranged as moveable in relation to the tip part and body part of the bolt and is located between the flexing organs and the turning pieces, and which flexing organs are supported into the body part of the oblique bolt and are against the support piece, which turning pieces are arranged to be with the bolt projection turned outwards from the slanted surfaces in the extracted position of the oblique bolt, and to turn from an external force directed onto the counter surface such that, as the deadlocking means lock the oblique bolt into the extracted position, the push projection pushes the counter push surface using the push surface, causing the support piece to turn and move towards the flexing organs, until the counter surface of the bolt projection is at least partially in the plane of the slanted surface of the tip part, wherein the external force is directed onto the slanted surface.

2. A door lock according to claim 1, wherein the slanted surface is at a gently sloping angle or right angle in relation to the surface of the face plate on that area, onto which the external force is directed, wherein the external force is directed onto the slanted surface at a right angle or at nearly a right angle.

3. A door lock according to claim 2, wherein the flexing organs are a disc spring assembly.

4. A door lock according to claim 2, wherein the oblique bolt comprises springs for each of the turning pieces, which spring specific to a turning piece is arranged to turn the bolt projection towards another side surface of the recess.

5. A door lock according to claim 2, wherein the lock body has a roller on both sides of the oblique bolt, between the side of the lock body and the side of the oblique bolt.

6. A door lock according to claim 5, wherein on both sides of the oblique bolt is a groove, in which the roller is located, and the bolt hole has projections, which extend into the groove.

7. A door lock according to claim 6, wherein the lock body comprises at the site of the oblique bolt a body piece, against which the rollers are located, and which has said support surface on the inside of the face plate for the turning projection.

8. A door lock according to claim 2, wherein the counter surface of the bolt projection comprises a portion wider than the remaining turning piece.

9. A door lock according to claim 2, wherein on the other side of the bolt projection is a support surface, which is towards the other side surface of the recess, the oblique bolt of which door lock is arranged to move inwards towards the lock body, when the deadlocking means are in the unlocked position and an external force is directed into the bolt projection, wherein the turning surface of the push projection is arranged to turn in relation to the side of the recess, until the support surface of the bolt projection has settled against the other side surface of the recess.

10. A door lock according to claim 9, wherein the oblique bolt is arranged to turn from an external force directed onto the counter surface initially on the curved surface of the push projection, which is against the side surface of the recess, and thereafter on the support surface of the bolt projection, until it is completely turned against the other side surface of the recess.

11. A door lock according to claim 10, wherein when the support surface of the bolt projection is against the other side surface of the recess from an exterior force directed onto the counter surface, the counter surface is approximately or precisely in the plane of the slanted surface of the tip part.

12. A door lock according to claim 1, wherein the push projection of the turning piece comprises a nose, whose other side is included as a part of said push surface, and the back part of the tip part has a rear surface towards the counter push surface such that there is a gap between the rear surface and the counter push surface, in which the nose is located, when the oblique bolt is in the extracted position.

13. A door lock according to claim 12, wherein the push projection of the turning piece comprises another nose at the end of the curved turning surface, which is towards the tip of the tip part.

* * * * *